US005666591A

United States Patent [19]

Taya

[11] Patent Number: 5,666,591

[45] Date of Patent: Sep. 9, 1997

[54] IMAGE FORMING APPARATUS UTILIZING DISCHARGE CURRENT OF CHARGER

[75] Inventor: Yoichi Taya, Yokohama, Japan

[73] Assignee: Kabushiki Kaisha Toshiba, Kanagawa-ken, Japan

[21] Appl. No.: 497,685

[22] Filed: Jun. 30, 1995

[30] Foreign Application Priority Data

Jul. 14, 1994 [JP] Japan ..... 6-162320

[51] Int. Cl.[6] ..... G03G 15/02; G03G 15/06

[52] U.S. Cl. ..... 399/50; 399/55

[58] Field of Search ..... 355/203, 208, 355/219, 221, 225, 246; 361/225; 399/50, 55

[56] References Cited

U.S. PATENT DOCUMENTS 5,309,207 5/1994 Omori ..... 355/246

FOREIGN PATENT DOCUMENTS 62-89074 4/1987 Japan .

*Primary Examiner*—William J. Royer

*Attorney, Agent, or Firm*—Limbach & Limbach L.L.P.

[57] ABSTRACT

An image forming apparatus having a voltage generating circuit for generating a bias voltage which is supplied to a developing unit upon reception of a discharge voltage from the charger, for charging a photosensitive drum, based on the discharge voltage. The voltage generating circuit is controlled by a timing signal supplied from the CPU, so that the bias voltage is applied to the developing unit when the photosensitive drum rotates by a predetermined angle and is set at a position where development is carried out.

9 Claims, 5 Drawing Sheets

$T = L / Sp$

L : DISTANCE ON PHOTOSENSITIVE DRUM BETWEEN CHARGER AND DEVELOPMENT ROLLER

Sp : ROTATION PERIPHERAL SPEED OF PHOTOSENSITIVE DRUM

IMAGE FORMING APPARATUS UTILIZING DISCHARGE CURRENT OF CHARGER

BACKGROUND OF THE INVENTION

1. Field of the Invention

The present invention relates to an image forming apparatus such as a copying machine, for reading an image of an original, for example, and forming the image on a sheet in accordance with a signal thus read.

2. Description of the Related Art

A general operation of a copying machine is as follows. That is, a uniform electrostatic charge is applied on the surface of a photosensitive drum and the surface charge on an exposed portion is released by image exposure, so as to form an electrostatic latent image. The latent image is then visualized (developed) by supplying toner charged with a polarity opposite to that of the latent image, and thus obtained toner image is transferred on a sheet. Then, as the sheet is allowed to pass through a fixation device, the toner (image) is fixed on the sheet by heat.

As the above photosensitive drum, an OPC (organic photoconductor) drum is used, and a discharge of a negative polarity is carried out on the photosensitive drum by a charging device (charger). In order to stabilize the discharge characteristics of the charging device, a grid is used.

A high-voltage transformer (high-voltage power source) is assigned exclusively to each of the charging device, the grid and the development roller. The operations of these members are ON/OFF-controlled in an open-loop manner by a CPU serving to control the apparatus as a whole, in accordance with the timing for the formation of an image. Further, in order to stabilize the output to a preset value, each of the high-voltage transformers carries out a feedback operation.

In the above-described structure, the high-voltage transformers are independent from each other, and therefore the ON/OFF control, the output adjustment and the like are separately carried out.

Needless to say, an appropriate image is formed only when an output is output as it is supposed to be. However, in some cases, an abnormal output is generated, resulting in spending an excessive amount of toner, or causing damage to the apparatus such as a carrier developer. The abnormality discussed here includes, not only an abnormal output of the high-voltage transformers, but also abnormal operations due to an erroneous setting of the charging device or the disconnection of the charging wire (discharge wire). Further, if a grid voltage and a development bias voltage are supplied not at different timings with a predetermined interval therebetween, but at the same timing, the entire surface of the drum is blacked regardless of the image of an original to be copied, i.e. a so-called blacking development occurs, at the start of the image formation. In the case where the supply of the grid voltage and the supply of the development bias voltage are stopped at the same time, the charged surface of the drum exhibits the carrier development while passing the development roller.

Conventionally, in order to solve the above-described drawback, a circuit for outputting a signal indicating an abnormality to the CPU serving as a controller when an output from the high-voltage transformers becomes abnormal, or a switch for detecting the setting of the charging device is provided so as to control the output from the transformers when the CPU detects an abnormal signal or insufficient setting of the device, thus avoiding an abnormal image. However, with such a copying apparatus, the circuit structures of the high-voltage transformers and the apparatus itself are rendered complex, and accordingly, the production cost is inevitably increased.

SUMMARY OF THE INVENTION

The object of the present invention is to provide an image forming apparatus having a simple structure, with which an excessive consumption of toner, a carrier development and the like, caused by, for example, inappropriate setting of the charger, can be prevented.

According to the first embodiment of the present invention, there is provided an image forming apparatus comprising: means for charging a surface of an image carrier at a uniform electrostatic charge corresponding to a first voltage, the image carrier rotating in a predetermined direction; means for forming an electrostatic latent image by applying light onto the electrostatic charge on the image carrier; means for forming a developer image on the image carrier by applying a developer to the electrostatic latent image while the forming means is applied a second voltage; means for applying the first voltage to the charging means; means for generating the second voltage to be applied to the developer image forming means, upon reception of a third voltage generated by a discharge from the charging means, on the basis of the third voltage; and means for supplying the second voltage to the developer image forming means when an area of the image carrier charged by the charging means faces the developer image forming means.

The image forming apparatus of the present invention has a structure which is different from that of the conventional technique, where voltages are supplied separately to a charger and a discharger. According to the structure of the present invention, a discharge voltage of the charging device is used as a bias voltage, and supplied to the development device at a constant timing. With this structure, in the case where no voltage is supplied to the charging device for some reason, no voltage is supplied to the development device either. Consequently, unlike the conventional technique, the development error such as the so-called blacking development can be prevented with a simple structure without using a detection device for an abnormal voltage. In detail, the constant timing is controlled by a timing signal supplied from the printer CPU to the D/A converter when it is confirmed that a point on the image carrier rotates to a position where development can be carried out. When the rotation is completed, the bias voltage is supplied to the development device. Thus, an image formation device which can prevent an abnormal development can be provided.

Further, as the second embodiment using the grid electrode, there is provided an image forming apparatus comprising: means for charging a surface of an image carrier at a uniform electrostatic charge corresponding to a first voltage, the image carrier rotating in a predetermined direction; means for stabilizing the charge of the charging means; means for forming an electrostatic latent image by applying light onto the electrostatic charge on the image carrier; means for forming a developer image on the image carrier by applying a developer to the electrostatic latent image while the forming means is applied a second voltage; means for applying the first voltage to the charging means; means for generating the second voltage to be applied to the developer image forming means, and grid voltage to be applied to the grid electrode upon reception of a third voltage generated by a discharge from the charging means, on the basis of the third voltage; and means for supplying the second voltage to the developer image forming means when an area of the image carrier charged by the charging means faces the developer image forming means.

The image forming apparatus of the present invention has a structure which is different from that of the conventional technique, where voltages are supplied separately to a charger, a grid electrode, and a discharger. According to the structure of the present invention, a discharge voltage of the charging device is used as a grid voltage and a bias voltage, and supplied to the grid electrode and the development device at a constant timing. With this structure, in the case where no voltage is supplied to the charging device for some reason, no voltage is supplied to the development device either. Consequently, like the first embodiment, the development error such as the so-called blacking development can be prevented with a simple structure without using a detection device for an abnormal voltage. In detail, the constant timing is controlled by a timing signal supplied from the printer CPU to the D/A converter when it is confirmed that a point on the image carrier rotates to a position where development can be carried out. When the rotation is completed, the bias voltage is supplied to the development device.

Further, at the end of the image formation, the development bias of the development roller, which is set at the predetermined development bias voltage VB, is continuously applied from the point when the charge on the charge position of the photosensitive drum is stopped, to the point when the drum is set at the position facing the development roller, and the development bias voltage is set to 0 V after the drum is set at the position facing the development roller.

Thus, a blacking development which may occur at the start of an image formation, and a carrier development which may occur at the end of an image formation can be prevented.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DETAILED DESCRIPTION OF THE PREFERRED EMBODIMENT

Embodiments of the present invention will now be described with reference to the accompanying drawings.

Figure 1:
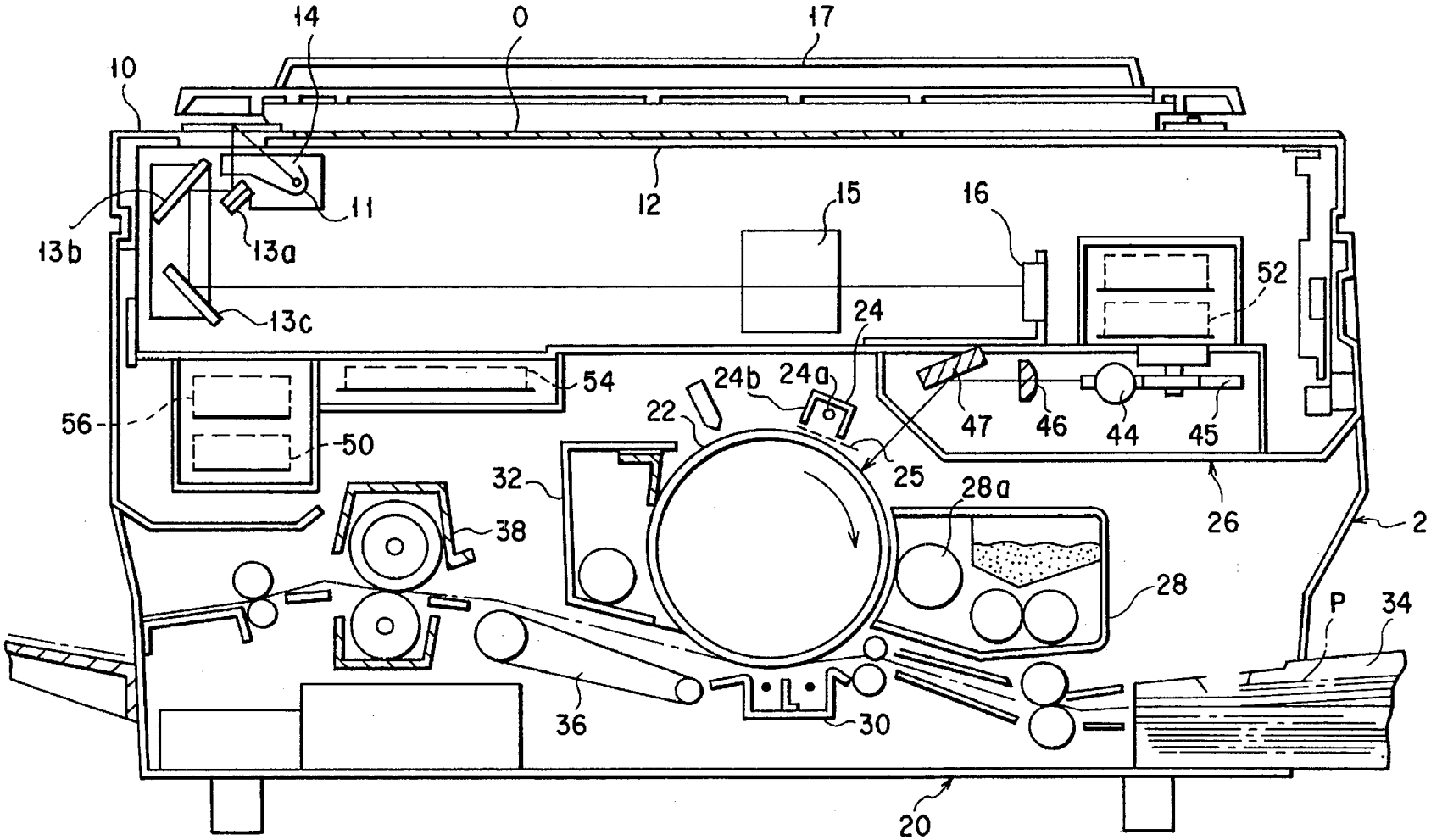
FIG. 1 is a cross section showing an overall structure of an image forming apparatus.

FIG. 1 is a diagram briefly showing the internal structure of an image forming apparatus (digital copying machine) according to the present invention.

As shown in this figure, an image forming apparatus 2 includes a scanner unit (reading means) 10 for optically reading image data of an original and a printer unit 20 serving as an image forming unit, for outputting the image data on a recording medium, that is, a copy sheet, in accordance with an image signal read via the scanner unit 10, or supplied from an external device (not shown).

Figure 2:
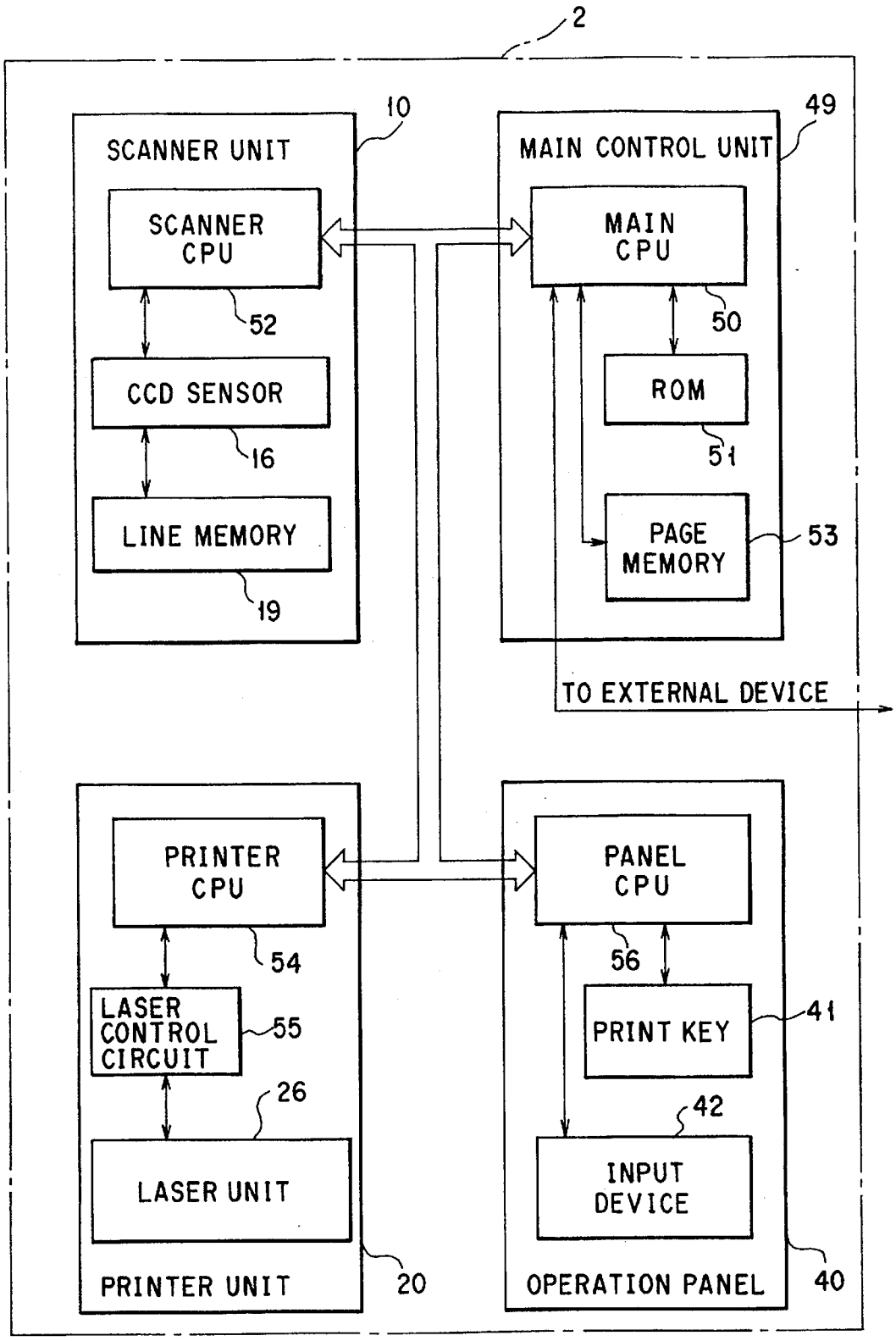
FIG. 2 is a block diagram briefly showing an overall control system of the image forming apparatus.

The scanner unit 10 has an original sheet placing table (original sheet table) 12 on which an original O to be copied is to be placed, a light source 14 for illuminating the original O placed on the original placing table 12, and a CCD sensor 16 for converting reflection light from the original O illuminated by the light source 14 into a data signal by photoelectric conversion. An image data signal is formed based on the data signal from the CCD sensor 16 and provided to line memory 19 (FIG. 2).

On a side of the light source 14, a reflector 11 for efficiently concentrating the illumination light from the light source 14 on the original O is provided. Between the light source 14 and the CCD sensor 16, a plurality of mirrors 13*a*, 13*b* and 13*c* for bending the light path through which the light directed from the original O to the CCD sensor 16, that is, the reflection light from the original O, passes, and a lens 15 for concentrating the reflection light on the light collecting surface of the CCD sensor 16 are provided.

On the upper portion of the original sheet placing table 12, an original holder 17 for holding the original O tightly on the table 12, is provided. The original holder can be replaced by, for example, an SDF (semi-automatic document feeder) or an ADF (automatic document feeder), in accordance with the size or the copying capability of the image forming apparatus 2.

The drum 22 has a cylindrical shape and is formed rotatable in a desired direction by means of a motor (not shown). The drum 22 is a photoelectric converting element (image carrier), on which an electrostatic latent image is formed by charging the drum at a predetermined potential, and applying a light beam to change the potential of the beam-applied region.

Around the periphery of the photosensitive drum 22, a charger (charging device) 24 for giving a predetermined potential to the photosensitive drum 22, a laser unit (output means) 26 for outputting an image signal or a print signal from an image processing unit, which will be described later, that is, a laser beam (light beam) which is formed in an ON/OFF manner in accordance with the image data to be copied or outputted, a laser control circuit 55 for controlling the laser unit 26, a development device (developing means) 28 for developing an electrostatic latent image formed on the photosensitive drum 22 by the laser beam from the laser unit 26 by supplying a visualizing agent (developer), namely, toner, using a development roller 28*a*, to the latent image, a transfer device 30 for transferring the toner image on the photosensitive drum 22 developed by the development device 28, onto a recording material (image forming medium), that is, a copy sheet P, fed from a recording material feeding unit 34, which will be described later, and the like are supplied in the above described order. To the development roller 28*a* development bias voltage of −300 V to −600 V from a power supplying circuit, which will be described later, is supplied.

The laser unit 26 consists of a semiconductor laser oscillator 44 for generating a laser beam, a polygon mirror 45 for converting the laser beam supplied from the semiconductor laser oscillator 44 via a collimating lens (not shown) into beams each for one scanning line, an fθ lens 46 for converting the beams each for one scanning line from the polygon mirror 45, into parallel light beams, a mirror 47 for guiding the parallel light beams from the lens 46 to the photosensitive drum 22, and a mirror motor for rotating the polygon mirror 45.

The charger 24 consists mainly of a charging wire 24*a*, a conductive case 24*b* and a grid electrode 25. The charging wire 24*a* is connected to a high-voltage power source 54*h* for a corona discharge, and serves to induce a corona discharge on the surface of the photosensitive drum 22. The grid electrode 25 is connected to a power supply circuit for the grid electrode, and serves to control the amount of charge on the surface of the photosensitive drum 22 by a grid voltage at a potential of −500 V to −800 V.

Around the periphery of the photosensitive drum 22 and on the downstream side of the transfer device 30, a cleaner unit 32 for removing the toner remaining on the surface of the photosensitive drum 22 and erasing the change in potential created on the photosensitive drum 22 by the laser beam, for the next image formation (printing).

Between the development device 28 and the transfer device 30, the recording material feeding unit 34 is provided for feeding the copy sheet P on which the toner image formed on the photosensitive drum 22 is to be transferred, towards the transfer device 30.

In the rear state of the transfer device 30, and in the direction in which the copy sheet P on which the toner image has been transferred by the transfer device 30, is separated from the photosensitive drum 22, a fixation device 38 for fixing the toner image on the copy sheet P, and a conveying device 36, located between the fixation device 38 and the transfer device 30, for conveying the copy sheet P towards the fixation device 38 are provided.

The image forming apparatus 2 further includes a main control unit 49 shown in FIG. 2, an interface used for connection with a ROM 51 a page memory 53, an external device, etc., and the like.

An operation panel 40 is provided on the scanner unit 10 or the printer unit 20 of the image forming apparatus 2.

The operation panel 40 includes a print key 41 for instructing the start of a copying operation, and an input device 42 having, for example, a plurality of push-button switches or a transparent touch-sensor panel on its display screen (of an LCD or color cathode ray tube), for inputting conditions for an image output of the image forming apparatus 2, including the number of copies or prints, the magnification, the selection of a partial copy, and the coordinate of the region of the partial copy.

FIG. 2 is a block diagram briefly showing electrical connections between the members and units in the image forming apparatus 2 shown in FIG. 1, and the flow of signals for controlling the operations thereof. As shown in FIG. 2, in the image forming apparatus 2, the main CPU 50 of the main control unit 49 is independently connected to each of the scanner unit 10, the printer unit 20, and the operation panel 40, so that a scanner CPU 52, a printer CPU 54 and a panel CPU 56, which are connected to each other, are operated to be coupled with the main CPU 50.

Figure 3:
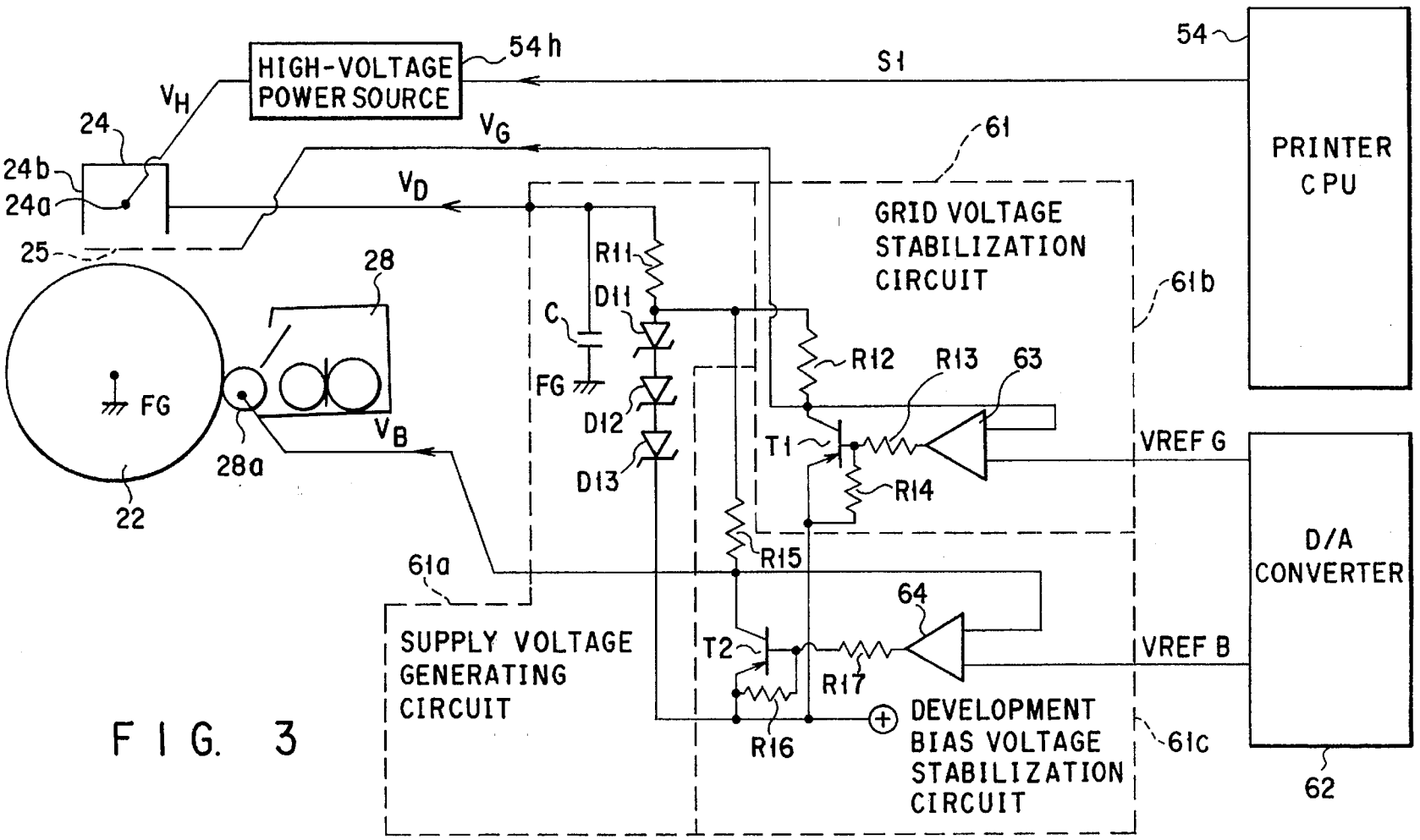
FIG. 3 is a diagram briefly showing a main structure of an image forming apparatus according to an embodiment of the present invention.
Figure 4:
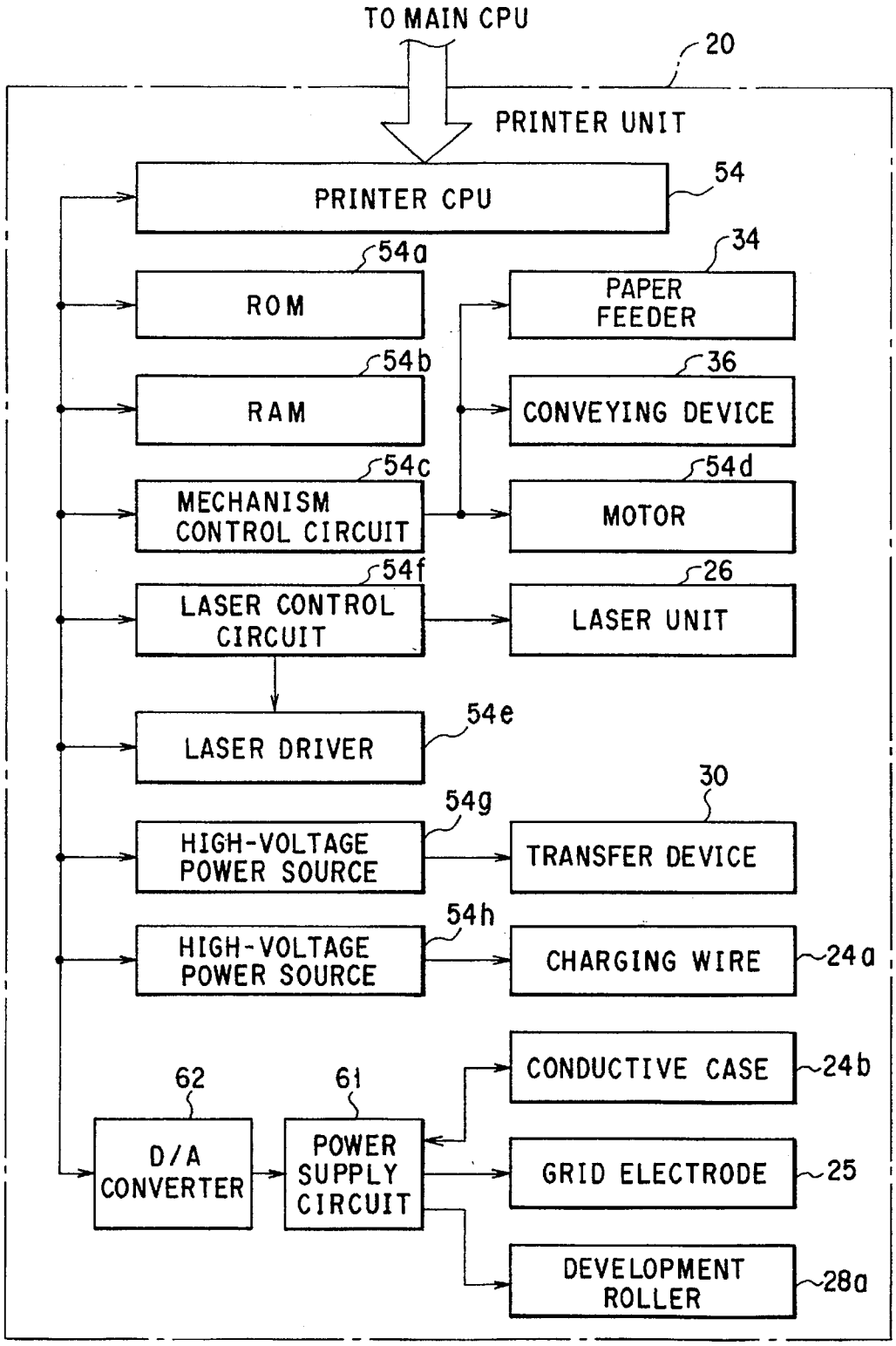
FIG. 4 is a block diagram briefly showing an overall control system of the image forming apparatus according to the embodiment.
Figure 5:
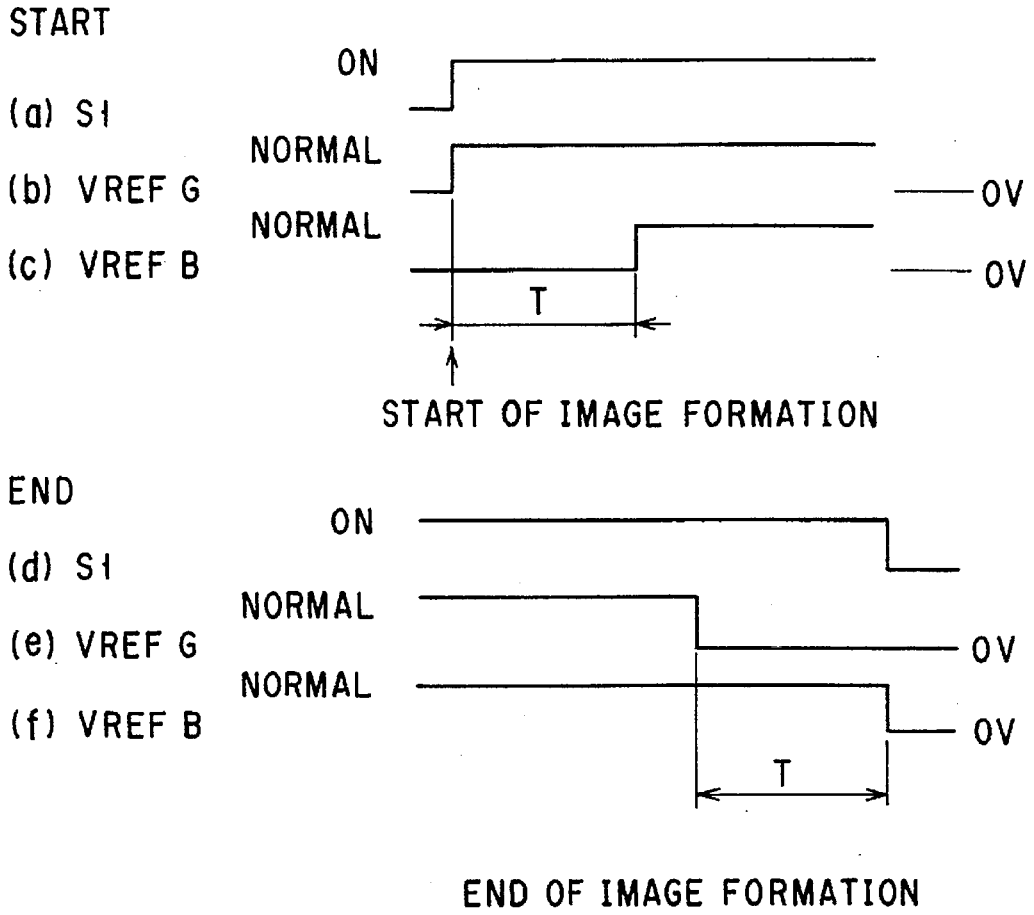
FIG. 5 shows timing charts briefly showing operation timings of the main portion, one for the start of an image formation and the other for the finish of an image formation, according to the embodiment.

FIG. 3 is a diagram briefly showing the structure of the main portion of the image forming apparatus according to an embodiment of the present invention. FIG. 4 is a block diagram briefly showing an overall control system of the image forming apparatus according to the embodiment. FIG. 5 shows timing charts briefly showing operation timings of the main portion, one for the start of an image formation and the other for the finish of an image formation, according to another embodiment.

As shown in FIG. 4, the printer unit 20 includes the printer CPU 54 for controlling the entire printer unit 20, a ROM 54*a* in which a control program and the like are stored, a RAM 54*b* for storing data, a paper feeder 34, a conveying device 36, a mechanism control circuit 54*c* for controlling a driving mechanism such as a motor 54*d* for rotating the photosensitive drum 22, a laser control circuit 54*f* for controlling the rotation of the laser unit 26 and controlling the laser driver 54*e* which controls the ON/OFF operation of the emission of light by light emitting means (not shown), a high-voltage power source 54*g* for supplying a power voltage to the transfer device 30, and a high-voltage power source 54*h*, whose turning ON/OFF is controlled by a remote signal from the printer CPU 54, for supplying a DC high voltage to the charging wire 24*a* when turned ON. Further, the printer unit 20 includes, as a feature of the present invention, the D/A converter 62 and a power supply circuit 61 connected to the conductive case 24*b*, the grid electrode 25 and the development roller 28*a*.

The power supply circuit 61, as shown in FIG. 3, consists of a supply voltage generating circuit 61*a* for generating a supply voltage based on a discharge current supplied to the conductive case 24*b* from the charging wire 24*a*, a grid voltage stabilization circuit 61*b* for outputting a stable grid voltage in accordance with the supply voltage generated by the supply voltage generating circuit 61*a* and a grid voltage stabilization circuit 61*b* supplied from the D/A converter 62, and a development bias voltage stabilization circuit 61*c* for outputting a stable development bias voltage in accordance with the supply voltage generated by the supply voltage generating circuit 61*a* and a grid voltage stabilization circuit 61*b* supplied from the D/A converter 62.

As shown in FIG. 3, the supply voltage generation circuit 61*a* consists of a capacitor C, a resistance R11, and Zener diodes D11, D12 and D13, the grid voltage stabilization circuit 61*b* consists of resistances R12, R13, R14, a PNP-type transistor T1, and a differential amplifier 63 made of an operation amplifier of a small gain, and the development bias voltage stabilization circuit 61c consists of a resistance R15, R16, R17 a PNP-type transistor T2 and a differential amplifier 64 made of an operation amplifier of a small gain.

The D/A converter 62 is provided between the power supply circuit 61 and the printer CPU 54. The D/A converter 62 outputs a grid reference voltage VrefG to the differential amplifier 63 of the grid voltage stabilization circuit 61*b* in accordance with a signal from the printer CPU 54, and outputs a development bias reference voltage VrefB to the differential amplifier 64 of the development bias voltage stabilization circuit 61*c*.

The operation of this circuit, including its operation timing, will now be described with reference to FIG. 5. In this figure, (a) represents the timing of a control signal S1 at the start of an image formation, (b) represents a grid reference voltage VrefG at the start of the image formation, (c) represents a development bias reference voltage VrefB at the start of the image formation, (d) represents the timing of a control signal S1 at the end of the image formation, (e)

represents a grid reference voltage VrefG at the end of the image formation, and (f) represents a development bias reference voltage VrefB at the end of the image formation.

As represented by (a) of FIG. 5, the high-voltage power 54*h* is turned on by a control signal S1 from the printer CPU 54 at the start of an image formation, a high-voltage power VH is supplied to the charger 24. At the same time, as represented by (b), a grid reference voltage VrefG is output from the D/A converter 62 in response to a control signal from the printer CPU 54, and after a time period T, a development bias reference voltage VrefB is output from the D/A converter 62 as represented by (c). The time period T corresponds to a value obtained by dividing a distance L from the opposite position of the charger 24 of the D/A converter 62 to the opposition position of the development roller 28*a*, by a rotation peripheral speed Sp of the photosensitive drum 22 (T=L/Sp).

Further, as represented by (e) of FIG. 5, the grid reference voltage from the D/A converter 62 is rendered 0 V in response to the control signal from the printer CPU 54 at the end of the image formation, and after a time period T, the high-voltage power 54*h* is turned off in response to the control signal S1 from the printer CPU 54, and the development bias reference voltage VrefB from the D/A converter 62 is rendered 0 V in response to the control signal from the printer CPU 54 as represented by (d) and (f).

Therefore, at the start of an image formation, a discharge is carried out by applying a voltage VH to the charging wire 24*a* from the high-voltage power source 54*h* by a control signal S1 from the printer CPU 54, and a grid reference voltage VrefG is supplied to the differential amplifier 63 of the grid voltage stabilization circuit 61*b* from the D/A converter 62 so that the surface potential of the photosensitive drum 22 is charged at a set potential.

Along with the discharge of the charging wire 24*a*, a voltage VD from the conductive case 24*b* is supplied to the supply voltage generating circuit 61*a*, and a supply voltage generated by this circuit is supplied to the grid voltage stabilization circuit 61*b* and the development bias voltage stabilization circuit 61*c*.

Thus, the grid voltage stabilization circuit 61*b* compares the grid reference voltage VrefG supplied and the grid voltage VG applied to the grid electrode 25, with each other, and controls the grid voltage VG to have a value equivalent to the grid reference voltage VrefG. Consequently, the charging of the photosensitive drum 22 is started by the grid voltage VG.

At this time, in the development bias voltage stabilization circuit 61*c*, the development bias reference voltage VrefB is set at 0 V, and therefore the development bias voltage VB of the development roller 28*a* is set at 0 V. In the meantime, the surface potential at a development point on the photosensitive drum 22, which faces the development roller 28*a*, is substantially 0 V; however an abnormal development does not occur since the development bias voltage VB is set at 0 V.

When a time period T has passed from the point when the control signal S1 is turned on, that is, when the charge start position of the photosensitive drum 22 is set at a position facing the development roller 28*a*, the development bias reference voltage VrefB is supplied from the D/A converter 62 to the differential amplifier 64 of the development bias voltage stabilization circuit 61*c* so as to generate a proper development bias voltage VB.

Thus, the development bias voltage stabilization circuit 61*c* compares the development bias reference voltage VrefB supplied and the development bias voltage VB applied to the development roller 28*a*, and controls the development bias voltage VB to have a value equivalent to that of the development bias reference voltage VrefB. Thus, the development of the latent image on the photosensitive drum 22 is started by the development bias voltage VB. The grid voltage VG and the bias voltage VB are, for example, −700 V and −450 V, respectively.

At the end of the image formation, the grid reference voltage VrefG from the D/A converter 62 is set at 0 V under the control of the printer CPU 54. Thus, the grid voltage VG is set at 0 V and the surface potential of the photosensitive drum 22 is set at 0 V. During this period, the surface potential of the photosensitive drum 22 at the development point is the same as that at the formation of the image, a reference voltage maintained at the same value at the time of the development bias image formation is applied to the differential amplifier 64 of the development bias voltage stabilization circuit 61*c* until the surface of the charged photosensitive drum 22 has passed the development point.

After a time period T has passed from the point when the grid voltage VG became 0 V, that is, when the charge completion position of the photosensitive drum 22 is located at a position facing the development roller 28*a*, the high-voltage power source 54*h* is turned off by the printer CPU 54. When the high-voltage power source 54*h* is turned off, the voltage VD from the conductive case 24*b*, which is generated along with a discharge of the charging wire 24*a*, is no longer supplied to the supply voltage generation circuit 61*a*, and the development bias reference voltage VrefB from the D/A converter becomes 0 V. So does the development bias voltage VB of the development roller 28*a*.

With the above-described operation, an abnormal development does not occur at the end of an image formation.

As described, according to the embodiment of the present invention, at the start of an image formation, the development bias voltage VB of the development roller is set at 0 V until the photosensitive drum originally set at the charge start position is rotated to be located at a position facing the development roller, and a predetermined development bias voltage VB is applied from the point when the drum is set at a position facing the development roller. Further, at the end of the image formation, the development bias of the development roller, which is set at the predetermined development bias voltage VB, is continuously applied from the point when the charge on the charge position of the photosensitive drum is stopped, to the point when the drum is set at the position facing the development roller, and the development bias voltage is set to 0 V after the drum is set at the position facing the development roller.

Thus, a blacking development which may occur at the start of an image formation, and a carrier development which may occur at the end of an image formation can be prevented.

Further, in the above-described embodiment, a grid voltage and a bias voltage are supplied in accordance with a discharge from the charger case; however, naturally a similar effect at the start of the image formation can be obtained if the grid voltage is not supplied, but only the bias voltage is supplied in the case where no grid is used.

Moreover, in the case where the polarity of the charge characteristics of the photosensitive member is opposite to that of the above-described embodiments, the same effect can be achieved by inverting the polarities of all the control voltages.

As mentioned before, according to the present invention, an image forming apparatus which can avoid drawbacks which may cause damage to the apparatus, such as excessive consumption of toner and a carrier, due to inappropriate setting of the charger, can be provided without using a complicated circuit or control, or raising the production cost.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus comprising:

means for charging a surface of an image carrier at a uniform electrostatic charge corresponding to a first voltage, the image carrier rotating in a predetermined direction;

means for forming an electrostatic latent image by applying light onto the electrostatic charge on the image carrier;

means for forming a developer image on the image carrier by applying a developer to the electrostatic latent image while, to the developer image forming means, is applied a second voltage;

means for applying the first voltage to the charging means;

means for generating the second voltage to be applied to the developer image forming means, upon reception of a third voltage generated by a discharge from the charging means, on the basis of the third voltage; and means for supplying the second voltage to the developer image forming means when an area of the image carrier charged by the charging means faces the developer image forming means.

2. An image forming apparatus according to claim 1, wherein the supplying means has means for supplying the second voltage to the developer image forming means when a position of the image carrier, which faces the charging means, moves to a position which faces the developer image forming means as the image carrier rotates.

3. An image forming apparatus according to claim 1, wherein the supplying means has a differential amplifier operated by a reference bias voltage having a reference value and the second voltage generated.

4. An image forming apparatus comprising:

means for charging a surface of an image carrier at a uniform electrostatic charge corresponding to a first voltage, the image carrier rotating in a predetermined direction;

means for stabilizing the charge of the charging means;

means for forming an electrostatic latent image by applying light onto the electrostatic charge on the image carrier;

means for forming a developer image on the image carrier by applying a developer to the electrostatic latent image while, to the developer image forming means, is applied a second voltage;

means for applying the first voltage to the charging means;

means for generating the second voltage to be applied to the developer image forming means, upon reception of a third voltage generated by a discharge from the charging means, on the basis of the third voltage;

means for generating a fourth voltage to be applied to the stabilizing means, upon reception of the third voltage generated by a discharge from the charging means, on the basis of the third voltage; and first supplying means for supplying the second voltage to the developer image forming means; and second supplying means for supplying the fourth voltage to the stabilizing means.

5. An image forming apparatus according to claim 4, wherein the first supplying means has means for supplying the second voltage to the developer image forming means when a position of the image carrier, which faces the charging means, moves to a position which faces the developer image forming means as the image carrier rotates.

6. An image forming apparatus according to claim 4, wherein the first supplying means has a differential amplifier operated by a reference bias voltage having a reference value and the second voltage generated.

7. An image forming apparatus according to claim 4, wherein the second supplying means has a differential amplifier operated by a reference bias voltage having a reference value and the fourth voltage generated.

8. An image forming apparatus according to claim 4, wherein the first and second supplying means have means for shutting off the second voltage applied to the developer image forming means when a position of the image carrier, which faces the charging means, at a point when the applying means shuts off the first voltage, moves to a position which faces the developer image forming means as the image carrier rotates.

9. An image forming method comprising the steps of:

applying a first voltage to a charger, the charger charging an image carrier which rotates in a predetermined direction;

charging a surface of the image carrier at a uniform electrostatic charge corresponding to the first voltage by means of the charger;

forming an electrostatic latent image by applying light onto the electrostatic charge on the image carrier;

generating a second voltage to be applied to a development roller, upon reception of a third voltage generated by a discharge from the charger, on the basis on the third voltage;

supplying the second voltage to the development roller when the image carrier rotates by a predetermined angle; and forming a developer image on the image carrier by applying a developer to the electrostatic latent image while the development roller is applied the second voltage.

* * * * *